United States Patent [19]

Germain

[11] 4,065,099

[45] Dec. 27, 1977

[54] IN-POST TENNIS NET TIGHTENER

[75] Inventor: Stanley A. Germain, Glendale, Calif.

[73] Assignee: L. A. Steelcraft Products, Inc., Pasadena, Calif.

[21] Appl. No.: 646,079

[22] Filed: Jan. 2, 1976

[51] Int. Cl.[2] ..... A63B 61/04

[52] U.S. Cl. ..... 254/164; 273/29 BE

[58] Field of Search ..... 254/161, 162, 163, 164, 254/186 HC, 145, 64; 105/473; 273/29 BB, 29 BC, 29 BD, 29 BE, 29 BG, 29 BF; 24/115 R

[56] References Cited

U.S. PATENT DOCUMENTS

| | | | |
|---|---|---|---|
| 324,285 | 8/1885 | Withington | 254/164 |
| 978,989 | 12/1910 | Curren | 254/162 |
| 1,077,716 | 11/1913 | Isitt | 254/161 |
| 1,185,977 | 6/1916 | Brown | 254/186 HC |
| 1,300,972 | 4/1919 | Janssen | 273/29 BG |
| 1,526,126 | 2/1925 | Fitzherbert | 273/29 BF |

*Primary Examiner*—Trygve M. Blix
*Assistant Examiner*—Kenneth Noland
*Attorney, Agent, or Firm*—Christie, Parker & Hale

[57] ABSTRACT

A tennis net tightener is incorporated into the tennis net support so that the tightener is tamper proof and does not jut out from the support so as to injure tennis players.

3 Claims, 8 Drawing Figures

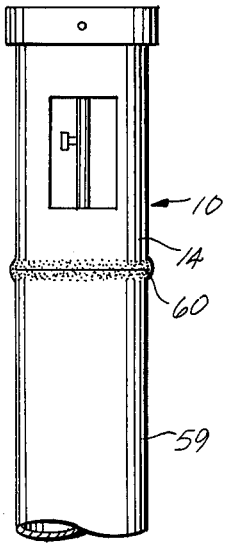
Fig. 5
Fig. 7
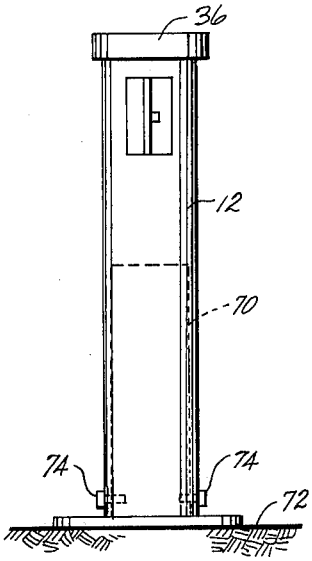
Fig. 6
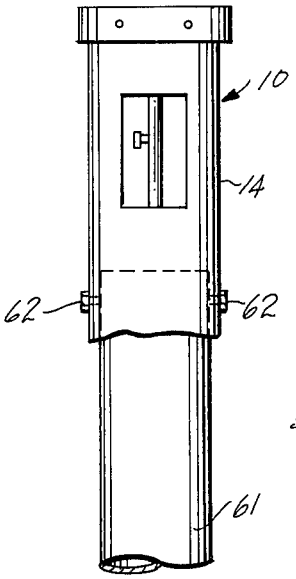
Fig. 4
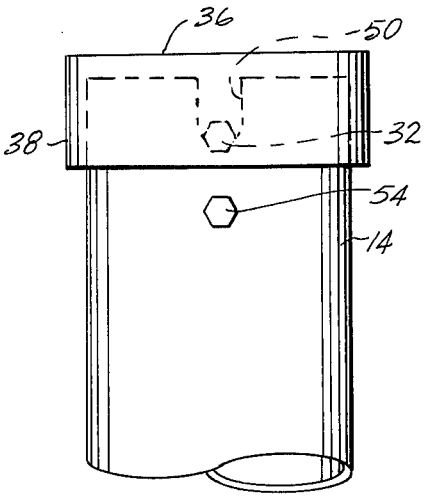
Fig. 8
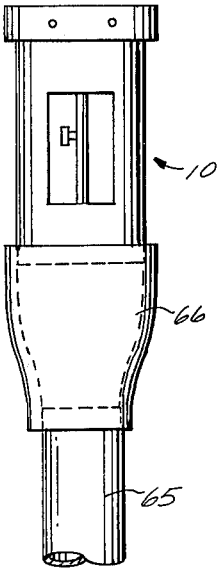

IN-POST TENNIS NET TIGHTENER

BACKGROUND OF THE INVENTION

This invention relates to means for applying tension to tennis nets supported by pole supports.

Typically tension is applied to a tennis net by turning a net tightener comprising a ratchet and pawl mechanism which is attached to a wire running along the top of the net. A crank is used to turn the ratchet. The crank, along with the ratchet and pawl mechanism, are attached to the side of the pole support used for supporting the net.

This arrangement with the net tightener on the side of the support has major disadvantages. First, since the crank juts out from the pole, it is a source of serious injury to unwary tennis players. On many occasions a player running to return a shot close to the net injures himself by running into the projecting tightener.

A second disadvantage is that a tennis net tightener secured to the side of a tennis net support pole is easily vandalized. In public playgrounds vandals release the tension on the net, remove the net from the support, and steal or destroy the net. Also, the net tightener is often removed and stolen.

A further disadvantage is that tennis players often adjust the height of the net by increasing or relieving the tension. Therefore, even if the height is properly set at the beginning of the day, a player arriving to play later in the day may be greeted with a net which is too high or too low.

Therefore there is a need for a tennis net tightener which does not project from the support, which is vandal proof, and which can be adjusted only by authorized personnel.

SUMMARY OF THE INVENTION

I have now invented a tennis net tightener with the above features. My invention contemplates a tightener which can be an integral part of the support for the net. The tightener is contained within a casing which in some applications can be formed by the wall of the tennis net support itself. Inside the casing is an axle with an attachment means such as a bolt for securing the tennis net to the axle. The net is tightened with a tool such as a wrench, and there are means on the axle for engaging the tightening tool. There is an opening in the casing to provide access to the means for securing the net to the axle.

Once tension is applied to the net there are means within the casing for preventing release of the tension. The casing has a cap which prevents vandals from releasing the tension on the net once the tension is applied. There is an opening in the cap for access to the means for engaging the tension applying tool. There is also an opening in the cap for access to the means for preventing release of tension. However, as described below, neither opening in the cap provides vandals with an opportunity for releasing the tension in the net.

In one embodiment of the invention the tightener is inserted into the tennis net supporting pole and the walls of the pole form the casing for the tightener. In another embodiment the tightener is provided as a modular unit wherein the tightener with casing are inserted into a tennis net support pole through an opening in the pole, and the cap of the tightener is used to close the opening. The tightener preferably is positioned so that it is substantially axially aligned with the pole. An opening is provided in the side of the pole through which the net is secured to the net securing means.

If the casing and an existing support pole are about the same diameter, the net tightening means can be directly welded to the pole. If an existing support pole is substantially larger or smaller than the casing, a transitional adapter can be used to secure the tamper-proof net tightener to the existing pole.

In a preferred embodiment of this invention, the means for preventing release of tension comprises a ratchet attached to the axle and a pawl attached to the casing. After the net is raised to the desired height the pawl engages the ratchet and prevents the ratchet from slipping backward and releasing the tension on the net. In order to lower the net, it is necessary first to tighten the net so that the pawl may be disengaged from the rachet. Therefore unauthorized personnel are unable to lower the net unless they have the special tool required to raise the net. Thus the net and tension applying means are tamper-proof.

Also, because the tennis net tightener is contained within the confines of the pole, tennis players do not become impaled on the tightener.

DRAWINGS

FIG. 4 is a back view of the tennis net tightener of FIG. 1;

FIG. 5 depicts a tennis net tightener embodying features of this invention welded to a tennis net support having about the same diameter as the tennis net tightener;

FIG. 6 depicts a tennis net tightener embodying features of this invention which is placed over a portion of a tennis net support of smaller diameter;

FIG. 7 shows a tennis net tightener embodying embodying features of this invention which is placed over an entire tennis net support of smaller diameter; and FIG. 8 shows a tennis net tightener embodying features of this invention secured to a smaller diameter tennis net support by means of a reducing adapter.

DESCRIPTION OF THE INVENTION

Figure 1:
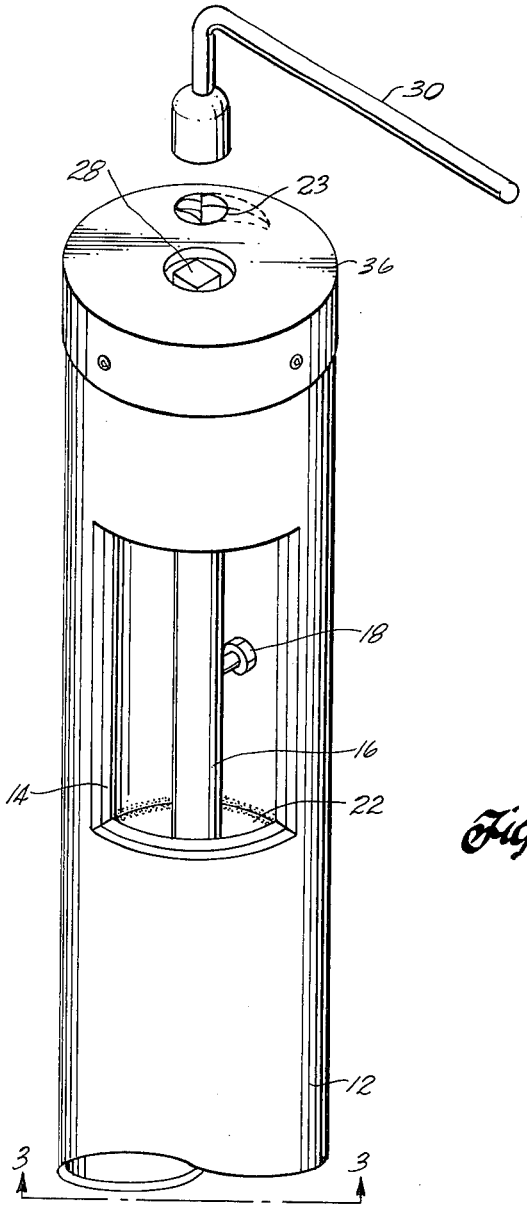
FIG. 1 is a frontal perspective view of a tennis net tightener embodying features of this invention and contained within a tennis net support pole.
Figure 2:
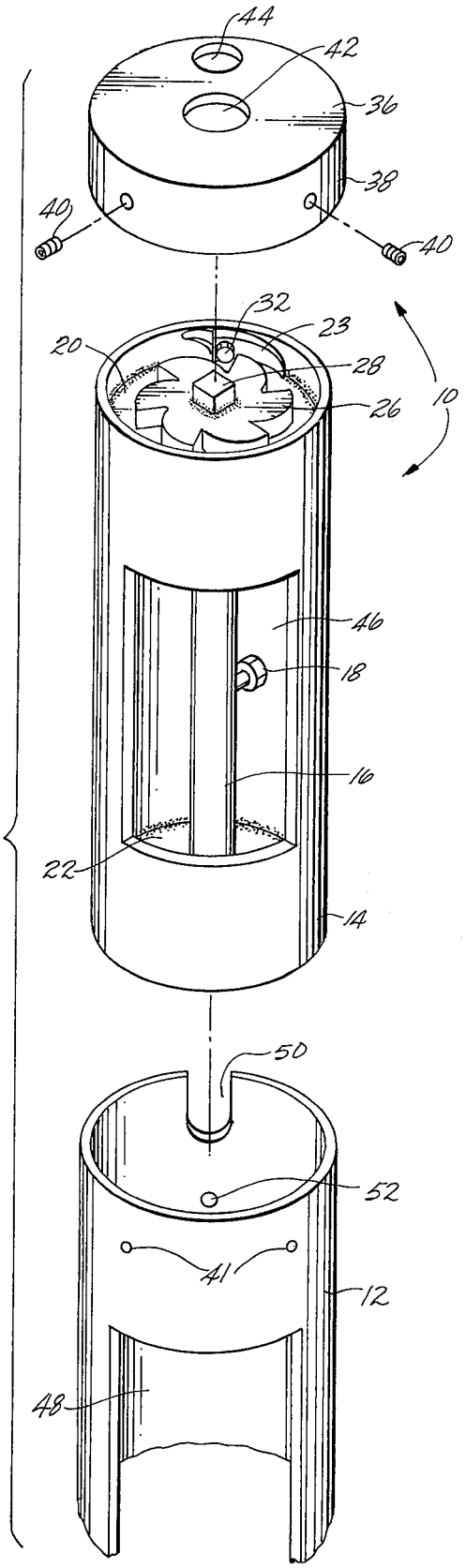
FIG. 2 is an exploded view of the tennis tightener of FIG. 1.
Figure 3:
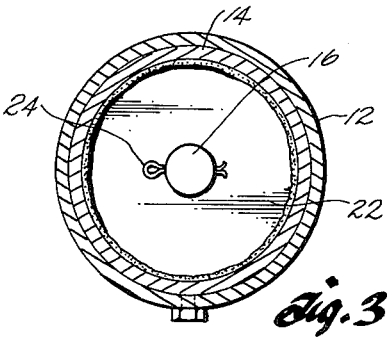
FIG. 3 shows the tennis net tightener of FIG. 1 along line 3—3 of FIG. 1.

As shown in FIGS. 1 and 2 a tamper-proof tennis net tightener 10 is positioned inside of a tennis net pole 12. The tightener 10 comprises a vertically oriented cylindrical casing 14. Coaxial with the casing is an axle 16 to which is attached a bolt 18 which serves as a tie point for attaching a tennis net support cable or wire to the axle. There are two end plates, a top end plate 20 and a bottom end plate 22 (FIG. 3) located within the casing. Both end plates are circumferentially welded to the casing, except that the top end plate 20 is not welded to the casing, in the area below a pivotally mounted pawl 23, so as not to interfere with the pivotal motion of the pawl. The pivotally mounted pawl 23 is secured to the inner wall of the casing by means of a hinge pin which conveniently is a bolt 32 having its head on the exterior of the casing. The pawl is curved to conform to the curvature of the cylindrical casing.

A cotter pin 24 extending radially through the axle below the bottom end plate 22 prevents the axle from being lifted out of the casing. Similarly, the axle is prevented from falling to the bottom of the casing by a ratchet wheel 26 mounted on the axle above the top end plate 20. The ratchet is secured, as by welding, to the axle above the top plate 20 but below the upper end of the casing.

The upper end 28 of the axle is disposed within the casing and extends above the ratchet wheel 26. The upper end of the axle is of square cross-section, or hexagonal if desired.

It is possible to rotate the axle and thereby apply tension to a tennis net attached to the axle by using a tool such as the offset-handled socket extension wrench 30 shown in FIG. 1 to turn the axle by engaging the square-headed axle end 28 with the tool.

The top open end of the support pole is covered by a cylindrical cap 36 having a downward extending flange 38. The cap is fastened to the pole by means of set screws 40 which extend through the flange 38 and into tapped holes 41 in the pole when the winch casing is inserted into the pole and the cap is placed over the open upper end of the pole. The cap has two holes, a centrally located hole 42 which provides access for the wrench to the axle head 28, and a smaller circular hole 44 which provides access to the end of the pawl 23 opposite from the end which cooperates with the ratchet wheel.

There is a window 46 in the side of the casing which provides access to the axle and the bolt 18 to enable a net support cable to be connected to the axle.

As shown in FIGS. 1 and 2, it is preferred that the tennis net tightener be provided as a modular unit which can be inserted into an existing tennis net support pole 12 with the tightener and pole being substantially axially aligned. The pole has a window 48, corresponding in size and shape to casing window 46, cut into it to provide access to the axle. The pole also has a slot 50 and a bolt hole 52 in it opposite from window 48. Slot 50 opens to the upper end of the pole and provides clearance for the head of pawl hinge bolt 32; bolt 32 is fully enclosed when cap 36 is connected to the pole as described above. Hole 52 is untapped and registers with a tapped hole (not shown) in casing 14 when the casing is placed in the pole and supported by engagement of the head of bolt 32 in the bottom of slot 50. A bolt 54 (FIG. 4) is then passed through hole 52 and is threaded into the casing to further secure the casing in the pole. When the casing is so mounted in the pole, the windows 46 and 48 register as shown in FIG. 1. The pole height is defined so that bolt 18 on the winch axle is then at the required height above the tennis court surface, i.e., the regulation height of the ends of a tennis net.

In operation, a wire (not shown) which typically runs the length of the top of the tennis net, is secured to the bolt 18. Then the tennis net is raised and tension is applied to the net by turning the axle with the wrench 30 which engages the axle head 28. The net is raised to the desired level and then the tool 30 is removed. The ratchet slips backwards and engages the pawl 23 which prevents unwinding of the winch. Because of the great force exerted by the ratchet wheel 26 on the engaged pawl 23, it is impossible to disengage the pawl from the ratchet to lower the net without first further tightening the net with a wrench. Therefore, in order to lower the net it is first necessary to extend the wrench 30 through the hole 40 to engage the axle head 28, and slightly tighten the net. After this is done it is a simple matter to insert a finger or extended tool into the hole 44 in the cap 36 to pivotally tilt the pawl to disengage it from the ratchet. Once the pawl 23 is disengaged from the ratchet, the net will fall under its own weight.

Because the net can be lowered or raised only by a special tool, such as the wrench 30 shown in FIG. 1, it is very difficult to vandalize or tamper with the tennis net tightener winch or the net. Also because the winch is contained within the confines of a supporting pole for a tennis net, there is no extending projection from the pole which can injure a tennis player or spectator.

The embodiment of the invention shown in FIG. 2 is for a modular tennis net tightener 10. The tightener can also be made in a version wherein the pole itself serves as the casing 14. This embodiment is particularly useful when the tightener and pole are supplied together. However, the disadvantages of using the pole as the casing, as opposed to the removable modular winch shown in FIGS. 1–4, is that disassembly and reassembly, when repair of the tightener winch is required, is made more difficult.

FIGS. 1–4 show a tightener where the outside diameter of the tightener is slightly smaller than the inside diameter of the pole. FIGS. 5–8 show embodiments of this invention where the diameter of the tightener is about the same or larger than the diameter of the pole.

As shown in FIG. 5, when the diameter of the casing 14 for the tightener is about the same as the diameter of the pole 59, a welded joint 60 can be used to secure the tightener to the pole. In this instance, the pawl hinge pin does not extend outside the casing, bolt 54 is not needed, and tapped holes 41 are provided in the casing to enable the cap to be engaged directly to the casing. This arrangement is not preferred because the winch cannot be repaired readily if needed.

As shown in FIG. 6, when the diameter of the casing 14 is larger than the diameter of the pole 61, the tightener casing can be slipped over the pole and secured to the pole by means of bolts 62 which extend through the casing and into the pole.

FIG. 7 shows a preferred embodiment of this invention useful where an existing pole 70 of smaller diameter than or the same diameter as casing 14 is to be used. Winch 10 of modular arrangement as shown in FIGS. 1–4, including casing 14, is mounted as described in the upper end of a length of pipe or tubing 12' which corresponds to pole 12. Pipe 12' has a circumferential bearing flange 71 affixed to its lower end to engage the tennis court surface 72. The inner diameter of pipe 12' is greater than the outer diameter of existing pole 70 so that the pipe can be fitted over the pole and be positioned by the pole with the pipe supported on the court surface via the bearing flange. The upper end of the existing pole is cut off about two feet above the court surface so that its stump is used to position the pipe. The length of pipe 12' is defined to place the winch window, and the corresponding window in the pipe, at the proper height above the court surface. The pipe is then secured to the pole stump by bolts 74 or the like passed through the pipe and threaded into the pole stump.

As shown in FIG. 8, another means for securing a tightener to a pole 65 is by means of an adapter 66. The adapter shown in FIG. 8 is a reducing adapter which is used by securing a large diameter tightener 10 to the adapter 66 which in turn is secured to a pole 65. An adapter may also be used for attaching a tightener to a pole whose diameter is larger than the tightener diameter.

Although the tennis net tightener of this invention has been described in terms of preferred embodiments and preferred methods for using the tightener, other embodiments and configurations of this invention will be apparent to those skilled in the art. These other embodiments may include tighteners which are horizontally oriented rather than vertically oriented, or a tightener which is secured to the side of the pole. This latter embodiment would not have the safety aspect of the tighteners of the preferred embodiment, but this embodiment would still retain the tamper proof feature. Also, the means on the axle for engaging the tightening tool may have unusual custom made shapes, such as being five sided, or have a nonconventional diameter so that a vandal would not have access to a tool which can be used for releasing the net. Also, the cap may have a single hole for access to both the pawl and the tightening bolt.

Because of variations which are possible in this invention and within the talents of those skilled in the art, the spirit and scope of the appended claims should not be limited only to the embodiments illustrated or described above.

What is claimed is:

1. A tamper-proof tennis net tension mechanism comprising:

a. an open ended support pole for a tennis net;
b. an open ended cylindrical casing within the pole substantially axially aligned with the pole, and wherein the pole open end and casing open end face in the same direction;
c. an axle coaxial with the casing inside the casing and rotatably supported thereby;
d. means for securing a tennis net support cable to the axle;
e. means secured to the axle for engaging a tool for applying tension to the tennis net by rotating the axle;
f. a ratchet connected to the axle;
g. a pawl secured to the casing and engagable with the ratchet to prevent release of tension on a tennis net support cable secured to the axle;
h. a cap for the open end of the pole;
i. an opening in the cap for access to the means for engaging the tension applying tool;
j. an opening in the cap for access to the pawl for disengaging the pawl from the ratchet; and
k. openings in the pole and the casing for access to the means for securing a net cable to the axle.

2. A tennis net tightener comprising:

a. a cylindrical casing having an open end;
b. a cap for the open end of the casing;
c. an axle rotatably mounted inside the casing;
d. means for attaching a tennis net support cable to the axle;
e. drive means connected to the axle adjacent the end of the casing operable for rotating the axle, thereby to wind about the axle a net support cable attached to the axle and to create tension in the cable;
f. means within the casing for preventing release of tension in a tennis net support cable attached to the axle;
g. an opening in the cap for access to the drive means;
h. an opening in the cap for access to the means for preventing release of tension; and
i. an opening in the casing for access to the means for attaching a tennis net support cable to the axle;
j. the casing being adapted to be positioned within a tennis net pole having an opening for access to the means for attaching a net support cable to the axle and an open end, the cap being adapted to cover the open end of the pole.

3. A tennis net tightener comprising:

a. a cylindrical casing having an open end;
b. a cap for the open end of the casing;
c. an axle rotatably mounted inside the casing;
d. means for attaching a tennis net support cable to the axle;
e. drive means connected to the axle adjacent the end of the casing operable for rotating the axle, thereby to wind about the axle a net support cable attached to the axle and to create tension in the cable;
f. means within the casing for preventing release of tension in a tennis net support cable attached to the axle;
g. an opening in the cap for access to the drive means;
h. an opening in the cap for access to the means for preventing release of tension; and
i. an opening in the casing for access to the means for attaching a tennis net support cable to the axle;
j. the bottom of the casing being securable to the top of a tennis net pole.

* * * * *